US005799721A

United States Patent [19]

Holzgruber et al.

[11] Patent Number: 5,799,721

[45] Date of Patent: Sep. 1, 1998

[54] METHOD OF REMELTING METALS TO FORM AN ELONGATE PORTION AND APPARATUS THEREFOR

[75] Inventors: Wolfgang Holzgruber; Harald Holzgruber, both of Bruck der Mur, Austria

[73] Assignee: Inteco Internationale Technische Beratung Ges.m.b.H, Bruck a.d. Mur, Austria

[21] Appl. No.: 787,687

[22] Filed: Jan. 23, 1997

[30] Foreign Application Priority Data

Jan. 29, 1996 [AT] Austria ..... A151/96

[51] Int. Cl.[6] ..... C22B 9/18

[52] U.S. Cl. ..... 164/470; 164/497; 75/10.24

[58] Field of Search ..... 164/470, 495, 164/497, 508, 509; 75/10.1, 10.24

[56] References Cited

U.S. PATENT DOCUMENTS

| | | | |
|---|---|---|---|
| 3,915,217 | 10/1975 | Ellebrecht et al. | 164/470 |
| 4,291,744 | 9/1981 | Medovar et al. | 164/470 |
| 4,642,495 | 2/1987 | Mori et al. | 310/52 |
| 4,919,191 | 4/1990 | Brodersen | 164/495 |

FOREIGN PATENT DOCUMENTS

| | | | |
|---|---|---|---|
| 2505378 | 8/1976 | Germany | 164/470 |

*Primary Examiner*—Kuang Y. Lin
*Attorney, Agent, or Firm*—Bachman & LaPointe, P.C.

[57] ABSTRACT

For the continuous remelting of metals—in particular steels and Ni— Co-base alloys—in a short, downwardly open water-cooled chill mold (20) for producing an elongate casting portion (26) the latter is produced either by continuous or stepwise withdrawal from the chill mold (20) or when the elongate casting portion (26) is stationary by corresponding lifting movement of the chill mold (20). In order to ensure on the one hand a sufficiently high and thus economical smelting rate and on the other hand a high level of quality in respect of the remelted elongate casting portions (26), the cross-sectional area of the smelting-off electrode (16) should be at least 0.5 times the cross-sectional area of the remelted elongate casting portion (26) and the smelting-off rate should be so adjusted that it corresponds to between 1.5 and 30 times the equivalent elongate casting portion diameter ($D_{eq}$) calculated from the circumference (U) of the casting cross-section, in accordance with the relationship:

$$D_{eq}=U/\pi.$$

22 Claims, 1 Drawing Sheet

METHOD OF REMELTING METALS TO FORM AN ELONGATE PORTION AND APPARATUS THEREFOR

BACKGROUND OF THE INVENTION

The invention concerns a method of continuously remelting metals—in particular steels and Ni— and Co-base alloys—to form an elongate portion by smelting off at least one self-consuming electrode in an electrically conductive slag bath provided in a short, downwardly open chill mold. The invention also concerns an apparatus for carrying out that method.

In the manufacture of for example highly alloyed tool steels—such as for example high-speed steels, ledeburitic chromium steels or other strongly liquating steels and alloys—the production of continuously cast elongate portions of small to medium cross-sections involves problems.

German published specification (DE-AS) No 1 608 082 discloses a continuous casting method with a high casting speed for producing an acceptable surface quality which is suitable for further processing. The casting speeds required for that purpose together with the necessary overheating of the metal result in sump lengths of several meters which in turn are the cause of the formation of severe core liquation or segregation phenomena, combined with shrinkage cavities. Bar steel produced from continuous castings of that kind cannot be used for a large part of the situations of use.

German laid-open applications (DE-OS) Nos 1 483 646 and 1 932 763, and also AT patent specification No 320 884, disclose various alternative configurations of the electroslag remelting method. The methods described therein, with self-consuming electrodes, permit the production of remelted blocks or ingots with a good surface at a slow block formation speed. The shallow sump depths which occur in that procedure result in uniform solidification between the edge and the core and thus afford good internal quality in respect of the remelted blocks or ingots. The use of short chill molds with downwardly movable bottom plates and electrode exchange permits in this case also the formation of relatively long elongate continuous casting portions. In regard to the manufacture of small dimensions however the production of the smelting-off electrodes required becomes difficult, and the procedure costs become high, because of the remelting rates which are then low.

In order to get round the problem of producing electrodes of small cross-sections, the use of so-called funnel chill molds or F-chill molds has been proposed; the chill mold has a portion which is enlarged upwardly in a funnel-like shape and which accommodates the slag bath, and it thus permits smelting of electrodes whose cross-section is that of the remelted block or ingot to be produced.

While casting outputs of at least between 5 and 10 t per hour and per casting are required in the continuous casting of formats of between 100 and 200 mm—round or square—even in slow casting, the smelting rates in the electro-slag remelting method (ESR-method) are at a maximum between 100 and 200 kg per hour with the same formats. In the case of continuous casting therefore the sump depths are between 4 m and 8 m. In contrast the sump depths in the case of the ESR-method measure between 100 and 300 mm.

In another operating procedure, it is proposed in accordance with AT patent specification No 399 463 that elongate portions of highly alloyed steels are cast at substantially lower casting speeds than are usual in continuous casting in order to produce an improved core region with at the same time the casting surface being covered by an electrically heated slag bath in order not to have to accept disadvantages in regard to the formation of the surface by virtue of excessive cooling. In that respect it is assumed that the liquid metal can be made available over a prolonged period of time at a constant temperature from a heatable ladle.

That method again frequently involves the problem of keeping large quantities of liquid metal hot, over a prolonged period of time. That is a matter of importance in particular when operation is conducted only with one elongate portion. Thus for example when casting molten batches with a total weight of 25 t to form an elongate casting portion of a diameter of for example 150 mm, at a casting rate of for example 2000 kg/h, the casting times are 12.5 hours. During that period of time, the molten material must be kept hot in a ladle or an intermediate vessel, and that in turn results in corresponding energy losses and a consumption of refractory cladding.

On the other hand there is also the problem of controlling the casting speed in the region of 2000 kg/h as the pouring spouts used here, with a pouring spout opening of about 8 mm, having a tendency to freeze up or become clogged, at low casting temperatures.

In consideration of that state of the art, the inventor set himself the aim of eliminating the disadvantages noted and affording an improved method for electro-slag remelting of metals.

That object is attained by the teaching of the independent claims; the appendant claims recite advantageous developments.

SUMMARY OF THE INVENTION

In accordance with the invention the smelting-off rate X in kg/h is to correspond to 1.5 to 30 times the elongate casting portion diameter—in particular the equivalent elongate portion diameter calculated from the circumference (U) of the casting cross-section, in accordance with the relationship $D_{eq}=U\pi$—, wherein the ratio of the cross-sectional area of one or more smelting-off electrodes to the cross-sectional area of the casting cross-section is selected to be greater than 0.5.

More specifically tests have shown that the disadvantages as set forth in the beginning opening part of this specification of the individual known methods can be avoided or eliminated in a surprisingly simple manner if, in the per se known electro-slag remelting method, operation is conducted at considerably higher smelting-off rates than hitherto, and if at the same time smelting-off electrodes of a cross-section which is large in comparison with the casting cross-section are used. Good results are already achieved if the cross-sectional area of the smelting-off electrode or electrodes is at least 50% of the cross-sectional area of the elongate casting portion to be produced. The values according to the invention in respect of the above-mentioned smelting-off rates in kg/h, in the case of round cross-sections, are to be at least 1.5 times—but not more than 30 times—the diameter in mm. In the case of elongate casting portions which differ from a round cross-section, it is readily possible to operate with that value for the equivalent diameter $D_{eq}$.

Particularly good results in terms of energy consumption and quality of the surface with at the same time a good center structure are achieved if the smelting-off rate in kg/h corresponds to 5–15 times the equivalent diameter $D_{eq}$ in mm and the ratio of the cross-sectional area of the smelting-off electrode or electrodes to the cross-sectional area of the casting cross-section to be produced is equal to or greater than 1.0. In that case, the remelting operation must be conducted in a per se known funnel chill mold or F-chill mold, while the freshly formed elongate casting portion is formed in the lower narrower part of the chill mold and the slag bath which is over the casting surface extends into the part which is enlarged in the funnel-like configuration, where the tip of the smelting-off electrode then dips thereinto.

The advantageous method according to the invention which has been depicted here in terms of the principle involved can be easily adapted to the operator requirements.

Thus for example the chill mold can be fixedly installed in a working platform and the elongate casting portion can be drawn off downwardly. The elongate portion however may also be built up on a stationary bottom plate and the chill mold can be raised as the elongate portion grows. The operation of drawing off the elongate portion or raising the chill mold can be effected continuously or in a stepwise procedure.

It is also possible for the chill mold to be caused to oscillate, which will be an attractive proposition in particular when the elongate casting portion is drawn off continuously.

In the situation where the elongate portion is drawn off in a stepwise movement or the chill mold is raised with a stepwise movement, each stepping movement may additionally be followed directly by a stepping movement in the opposite direction, in which case the length of the oppositely directed stepping movement can be up to 60% of the length of the stepping movement for drawing off the elongate casting portion.

In the conventional electro-slag remelting method the melting current flows through the slag between the electrode tip and the molten sump or, in the case of bifilar installations or installations with a three-phase feed, between the electrodes. A current supply configuration of that kind is also possible with the method according to the invention.

If operation is conducted with funnel-shaped chill molds, good results are also achieved with a current supply configuration between the electrode and the mold wall.

Particularly good results in terms of the distribution of heat in the slag bath are achieved with an arrangement in which the electrode is connected to the one pole of the transformer while the second pole of the transformer is simultaneously connected both to the elongate casting portion and also to one or more current-conducting elements which are fitted into the mold wall.

BRIEF DESCRIPTION OF THE DRAWINGS

Further advantages, features and details of the invention are apparent from the following description of a preferred embodiment and with reference to the drawing in which the single FIGURE is a diagrammatic view in longitudinal section through an apparatus for the electro-slag continuous casting smelting of metals with a lateral electrode in the waiting position.

DETAILED DESCRIPTION

Figure 1:
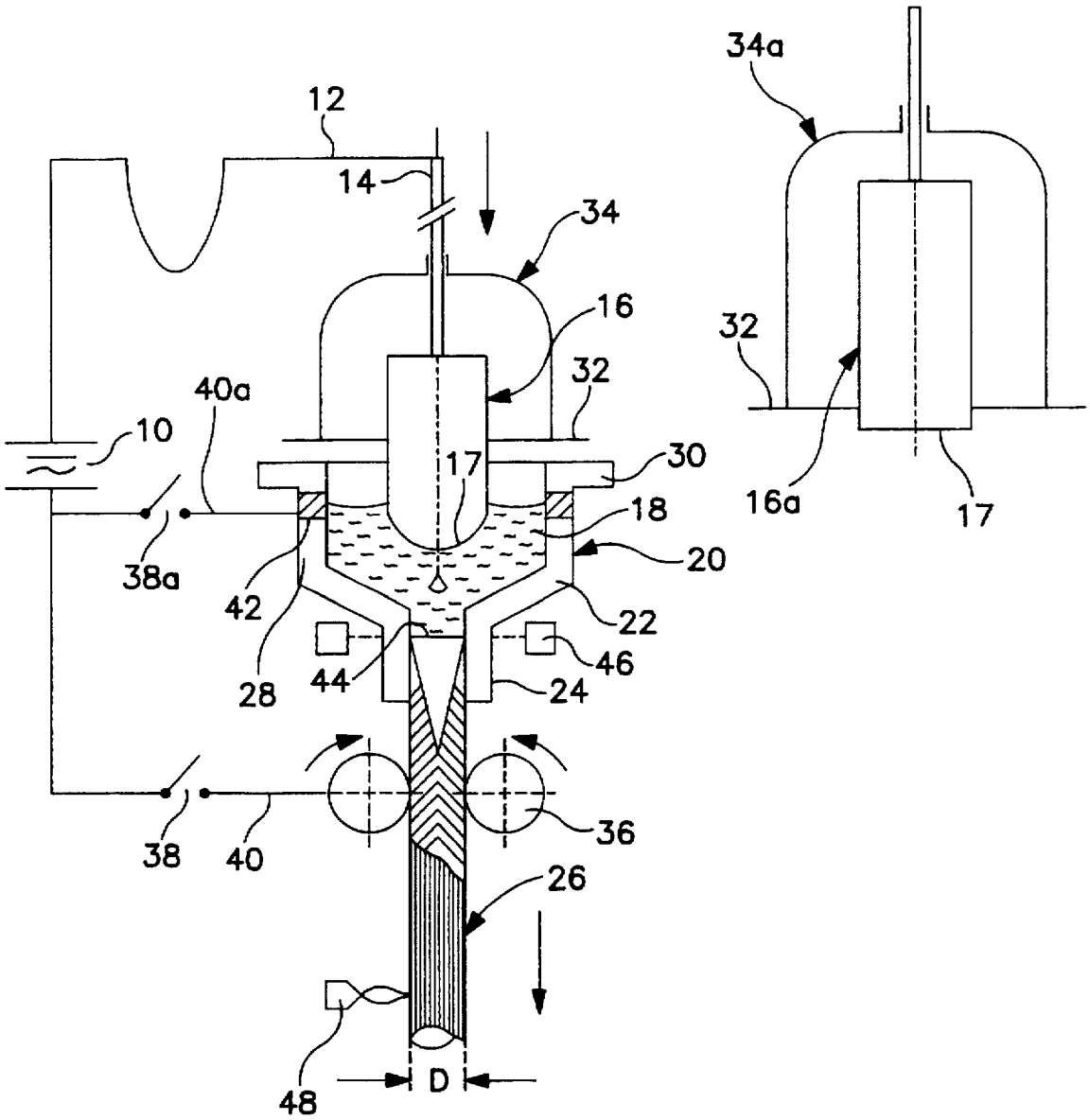

The one pole of a current source 10—supplying either alternating current or direct current—is connected by way of a feed line 12 to a suspension arrangement 14 of a smelting-off electrode 16. The electrode 16 is moved by an arrangement which is not specifically illustrated in the drawing, in such a way that the free end 17 of the electrode always dips into a slag bath 18.

The slag bath 18 is provided in a chill mold 20 which, in its chill mold bottom 22 which is of a funnel-like configuration in cross-section, has a tubular discharge portion 24 for a remelted elongate casting portion 26 which is formed therein, of a diameter D. At the upper edge of its wall 28 the chill mold 20 has a radially outwardly extending flange 30 which serves as a support for a co-operating flange 32 of a hood 34 which can be gas-tightly fitted thereon and which encloses the electrode 16.

The supply of current to the other pole of the current source 10 is effected either at the elongate casting portion 26 by way of a drive roller 36 which is in the form of a current take-off means and a heavy-current return line 40 including a heavy-current isolating switch device 38, or by way of a current conducting means 42 which is fitted into the chill mold wall 28 and another heavy-current return line $\mathbf{40}_a$, which is connected thereto, with a heavy-current isolating switch device $\mathbf{38}_a$. Current can also be passed by way of the elongate casting portion 26 and the current conducting means 42 jointly; in that case the return line is selected by actuation of the above-mentioned heavy-current isolating switch devices 38 and $\mathbf{38}_a$ respectively.

When both heavy-current isolating switch devices 38, $\mathbf{38}_a$ in the respective heavy-current return lines 40, $\mathbf{40}_a$ are switched in such a way that a flow of current therethrough is made possible, the proportion of the currents flowing by way of the current, conducting off means 42 and the drive rollers 36 as contacts depends on the ratio of the resistances in the slag bath 18. They are determined by the height of the slag bath 18 in relation to the current conducting means 42 or the spacing of the free end 17 of the electrode 16 from the level of metal 44 in the chill mold 20 for the elongate casting portion 26 which is solidifying in the discharge portion 24 of the mold.

The remelted elongate casting portion 26 is moved downwardly by the drive rollers 36 in a manner corresponding to the smelting of the electrode 16 and the level or surface 44 of the liquid metal in the narrower discharge portion 24 of the chill mold 20 is monitored by a monitoring device, in particular a radioactive beam source 46. At the same time, as already described above, the drive rollers 36 also act as a contact for the current return line 40 from the elongate portion 26 to the current source 10.

The desired portions can be cut to length from the elongate casting portion 26 for example by a burning cutting device which is indicated at 48.

When the first smelting electrode 16 has been consumed, it can be removed from the smelting region by devices (not shown here) and replaced by a fresh electrode $\mathbf{16}_a$ which moves into the smelting position from a waiting position diagrammatically indicated at the right, so that the smelting procedure can be continued; continuous operation is made possible by a plurality of electrodes 16 being smelted away in succession.

The electrode 16, $\mathbf{16}_a$ and the slag bath 18 are protected from the access of air thereto by the hood 34, $\mathbf{34}_a$ which, as stated, is sealed off relative to the chill mold flange 30 by means of the hood co-operating flange 32.

The remelting operation can be effected in the above-described apparatus under a controlled atmosphere and with the exclusion of oxygen in the air, thereby also making it possible to produce remelted elongate casting portions 26 in a state of very high purity, while elements with an affinity for oxygen are prevented from being burnt away. In that respect, the procedure is to use smelting-off electrodes 16 whose cross-sectional area can be designated large in relation to the casting cross-section.

In the case of continuous casting shapes which differ from a round cross-section, it will be assumed that there is an equivalent diameter $D_{eq}$ for the remelted continuous casting portion 26, which can be derived from the circumference U with the following relationship:

$$D_{eq}=U/\pi.$$

EXAMPLE

To try out the technology according to the invention, an experiment was conducted on an ESR-installation with a lifting chill mold.

Chill mold: Funnel chill mold, diameter at bottom 160 mm, diameter at top 350 mm Smelting electrode: 220 mm diameter Steel: A151 standard M2

After melting down 55 kg of slag of a composition of 30% CaO, 30% $Al_2O_3$ and 40% $CaF_2$, the chill mold stroke movement was adjusted in such a way that the level of steel was kept at about 20 to 30 mm below the funnel attachment in the lower chill mold portion with a diameter of 160 mm.

The electrical power was set at 750 kW at 10 KA and 75 volts in the slag bath 18, the energy being introduced into the slag bath 18 by way of the electrode 16 and being taken off both by way of the elongate portion 26 and also by way of the chill mold wall 28 of the upper part which is enlarged in a funnel-like configuration.

Under those conditions, the smelting-off rate which occurred was between 820 and 900 kg/h. In a corresponding manner the chill mold 20 was raised at a mean speed of between 87 and 95 mm/min, the lifting movement being effected stepwise with a stepping movement length of about 10 mm. The lift movement frequency was monitored and controlled by way of a radioactive casting level measurement system.

An elongate casting portion 26 of a length of about 3.0 m was produced. The surface quality was good so that no surface treatment was required prior to hot working. The elongate casting portion 26 was subjected to preliminary forging on a forging hammer without difficulty to afford a billet which was 100 m square.

Metallographic investigation revealed a uniformly fine-grain carbide distribution. No center liquation or segregation phenomena were found.

We claim:

1. A method for remelting Ni and Co based alloys by using a remelting apparatus comprising a chill mold, an electrically conductive slag bath provided in the chill mold, at least one smelting-off electrode extending into the slag bath and an elongated casting portion emerging from the chill mold wherein the smelting-off rate of the electrode is adjustable, said method comprises the step of:

adjusting the smelting-off rate X of the at least one electrode such that $$X=(1.5 \text{ to } 30)D$$

wherein D is the diameter or equivalent diameter of the elongated casting portion in millimeters, wherein the ratio R of the cross-sectional area of the at least one electrode to the cross-sectional area of the casting portion is greater than 0.5.

2. A method according to claim 1 wherein an equivalent elongate casting portion diameter ($D_{eq}$), which is calculated from the circumference (U) of the casting cross-section, is in accordance with the relationship $D_{eq}=U/\pi$.

3. A method according to claim 1 wherein X=(5 to 15) D and R is equal to or greater than 1.0, wherein the elongate casting portion is formed in a lower narrow portion of the chill mold and the slag bath extends into an enlarged upper portion of the chill mold.

4. A method according to claim 2 wherein X=(5 to 15) D and R is equal to or greater than 1.0, wherein the elongate casting portion is formed in a lower narrow portion of the chill mold and the slag bath extends into an enlarged upper portion of the chill mold.

5. A method according to claim 1 including the step of drawing off out of the chill mold in a continuous fashion the elongate casting portion.

6. A method according to claim 1 including the step of drawing off out of the chill mold in a stepwise manner the elongate casting portion.

7. A method according to claim 1 including the step of maintaining elongate casting portion stationary and continually raising the chill mold.

8. A method according to claim 1 including the step of maintaining the elongate casting portion stationary and raising in a stepwise manner the chill mold.

9. A method according to claim 1 including the step of oscillating the chill mold.

10. A method according to claim 6 including the step of, after each stepwise movement in one direction, a stepwise movement in the opposite direction is effected, the length of which is selected to be at most 60% of the length of the preceding stepwise movement.

11. A method according to claim 4 including the step of drawing off out of the chill mold in a continuous fashion the elongate casting portion.

12. A method according to claim 4 including the step of drawing off out of the chill mold in a stepwise manner the elongate casting portion.

13. A method according to claim 4 including the step of maintaining elongate casting portion stationary and continually raising the chill mold.

14. A method according to claim 4 including the step of maintaining, the elongate casting portion stationary and raising in a stepwise manner the chill mold.

15. A method according to claim 4 including the step of oscillating the chill mold.

16. A method according to claim 4 including the step of, after each stepwise movement in one direction, a stepwise movement in the opposite direction is effected, the length of which is selected to be at most 60% of the length of the preceding stepwise movement.

17. A method according to claim 1 including the step of providing a melting current flowing between the electrode and the elongate casting portion.

18. A method according to claim 1 including the step of providing a melting current flowing between the electrode and the chill mold.

19. A method according to claim 1 including the step of providing a melting current flowing between the electrode and, both the elongate casting portion and also the chill mold.

20. A method according to claim 4 including the step of providing a melting current flowing between the electrode and the elongate casting portion.

21. A method according to claim 4 including the step of providing a melting current flowing between the electrode and the chill mold.

22. A method according to claim 4 including the step of providing a melting current flowing between the electrode and, both the elongate casting portion and also the chill mold.

* * * * *